US007185908B2

(12) United States Patent
Emig

(10) Patent No.: US 7,185,908 B2
(45) Date of Patent: Mar. 6, 2007

(54) DOWNHILL SKI

(75) Inventor: Uwe Emig, Waldbrunn (DE)

(73) Assignee: Sportstec Gesellschaft zur Entwicklung Innovativer Technologien Uwe Emig, Prof. Reinhold Geilsdorfer, Markus Gramlich GBR, Mosback (DE)

( * ) Notice: Subject to any disclaimer, the term of this patent is extended or adjusted under 35 U.S.C. 154(b) by 0 days.

(21) Appl. No.: 10/534,758

(22) PCT Filed: Nov. 14, 2003

(86) PCT No.: PCT/DE03/03788

§ 371 (c)(1),
(2), (4) Date: May 13, 2005

(87) PCT Pub. No.: WO2004/045727

PCT Pub. Date: Jun. 3, 2004

(65) Prior Publication Data

US 2006/0022431 A1 Feb. 2, 2006

(30) Foreign Application Priority Data

Nov. 19, 2002 (DE) ..... 102 54 063

(51) Int. Cl.
*A63C 5/04* (2006.01)

(52) U.S. Cl. ..... 280/609; 280/602; 280/601; 280/607

(58) Field of Classification Search ..... 280/601–602, 280/11.14, 11.16, 11.18, 607–610, 11.15, 280/25

See application file for complete search history.

(56) References Cited

U.S. PATENT DOCUMENTS

| | | | | |
|---|---|---|---|---|
| 3,398,968 | A * | 8/1968 | Mutzhas | 280/602 |
| 4,420,523 | A | 12/1983 | Wieme | |
| 5,199,734 | A * | 4/1993 | Mayr | 280/602 |
| 5,372,370 | A * | 12/1994 | Rohrmoser | 280/610 |
| 5,393,085 | A * | 2/1995 | Forneri | 280/602 |
| 5,393,086 | A * | 2/1995 | Le Masson et al. | 280/602 |
| 5,806,874 | A * | 9/1998 | Sedlmair | 280/602 |
| 5,915,717 | A * | 6/1999 | Faye | 280/602 |
| 6,182,998 | B1 * | 2/2001 | Huyghe et al. | 280/602 |
| 6,679,513 | B1 | 1/2004 | Emig et al. | |

FOREIGN PATENT DOCUMENTS

| | | | |
|---|---|---|---|
| CH | 385 692 | A | 12/1964 |
| DE | 199 17 992 | A1 | 11/2000 |
| EP | 0 729 769 | A1 | 9/1996 |
| EP | 1092454 | A1 * | 4/2001 |
| FR | 1.254.377 | A | 2/1961 |
| WO | WO 00/62877 | * | 10/2000 |

* cited by examiner

*Primary Examiner*—Christopher P. Ellis
*Assistant Examiner*—Vaughn Coolman
(74) *Attorney, Agent, or Firm*—Arent Fox PLLC

(57) ABSTRACT

A downhill ski having a ski body, which has a running surface on its under side, comprises on its upper side a support structure, on which a compressive force-absorbing upper chord element is mounted. The support structure is formed from an elongate flat component that is bent, preferably in an undulating manner, at intervals in alternating directions in each case at an angle to the running surface, about substantially parallel axes, which extend transversely to the longitudinal direction of the ski.

15 Claims, 4 Drawing Sheets

DOWNHILL SKI

CROSS-REFERENCE TO RELATED APPLICATION

This application is a National Stage entry of International Application Number PCT/DE2003/003788, filed Nov. 14, 2003. The disclosure of the prior application is hereby incorporated herein in its entirety by reference.

BACKGROUND OF THE INVENTION

1. Field of the Invention

The invention relates to a downhill ski having a ski body, which has a running surface on its under side and, on its upper side, comprises at least one upper chord element which is supported on the ski body by its ends, extends in the longitudinal direction of the ski body and absorbs tensile and compressive forces.

2. Description of the Related Art

In a downhill ski of the specified type known from DE 199 17 992, the upper chord element, which is built into the ski body in the central region of the ski, has the shape of a flat, upwardly curved arc, which extends in the longitudinal direction of the ski and spans an underlying lower chord element arranged in the ski body. The arc of the upper chord element may be bent in the direction of the ski body as a function of the stress on the ski binding, and the upper chord element is supported on the end regions of the ski in such a way that, as a result of the bending of the arc, a displacement of the ends of the upper chord element causes an increase in the contact area of the end regions of the ski.

SUMMARY OF THE INVENTION

The object of the invention is to provide a downhill ski of the type mentioned at the outset, which is distinguished by good running properties and good controllability.

The object is achieved by the invention recited in claim 1. Advantageous embodiments of the invention are recited in the subclaims.

The downhill ski according to the invention comprises on its upper side a support structure, on which the upper chord element is supported and which is formed by an elongate flat component, which is bent, preferably in an undulating manner, at intervals in alternate directions at an angle to the running surface, about substantially parallel axes that extend transversely to the longitudinal direction of the ski.

The configuration of the ski according to the invention permits a favorable compromise between, on the one hand, the desired flexional elasticity and, on the other hand, the required torsional strength of the ski, and allows advantageously uniform surface pressure distribution. Due to the undulating configuration of the support structure, said requirements can be met with a comparatively low overall weight. In addition the ski may be produced at low cost.

The support structure of the ski may advantageously consist of a fiber/plastics material composite or of a metal sheet or of a combination of the aforementioned materials. The component forming the support structure may have a uniform wall thickness, but its wall thickness may also be non-uniform. The width of the component and hence of the support structure may also vary in the longitudinal direction of the ski. Furthermore, an advantageous embodiment may be one where the support structure is formed from a plurality of components that lie side by side. The individual components may have identical or different undulating profiles. In addition, the undulating profiles of the individual components may be arranged offset from each other in the longitudinal direction of the ski.

The overall height of the support structure preferably decreases from the centre of the ski toward the ends of the ski. The angle of inclination of the individual undulations of the support structure may also decrease from the centre of the ski toward the ends of the ski, but it may also be constant over the length of the ski.

The upper chord element preferably consists of one or more rods or tubes, in particular with a round cross-section, and is produced from a high-strength material, in particular from an aluminium-titanium alloy, from glass or carbon fiber fabric or from a combination of these materials.

According to a further suggestion of the invention for mounting the upper chord element, the support structure may comprise openings or recesses to allow the upper chord element to slide therethrough. The upper chord element is thereby arranged, at a distance from the ski body. The upper chord element is preferably supported in a sliding manner in the opening or recesses of the support structure.

In the case of the ski according to the invention, the ski body achieves the object of a tensile force-absorbing lower chord. The ski body contributes toward the absorption of flexional and torsional forces, due to its inherent rigidity and elasticity. The ski body is preferably configured as a sandwich construction and may consist of a fiber/plastics material composite and/or high-strength metal sheets and/or wood inlays. The overall height of the ski body is preferably low, in particular lower than the overall height of the support structure.

The connection between the support structure and the ski body may be effected by adhesive or cohesive means and/or by mechanical means such as screws, rivets or the like. On its upper side, the support structure may be covered completely or in part by a thin-walled plate-shaped element. A box-shaped casing, which is attached to the ski body, may also enclose the support structure including the upper chord element.

In order to attach the ski binding, a mount is arranged on the upper side of the downhill ski according to the invention, which mount is configured in such a way that the introduction of force by the skier mainly occurs via the upper chord element. For this purpose, the mount may be attached to the upper chord element and additionally guided on the support structure. Another advantageous embodiment may provide that the mount is attached to the support structure in a yielding or movable manner and is supported on the upper chord element.

BRIEF DESCRIPTION OF THE DRAWINGS

The invention will be described below in greater detail with reference to an embodiment shown in the drawings, in which.

DETAILED DESCRIPTION OF THE PREFERRED EMBODIMENT

Figure 6:
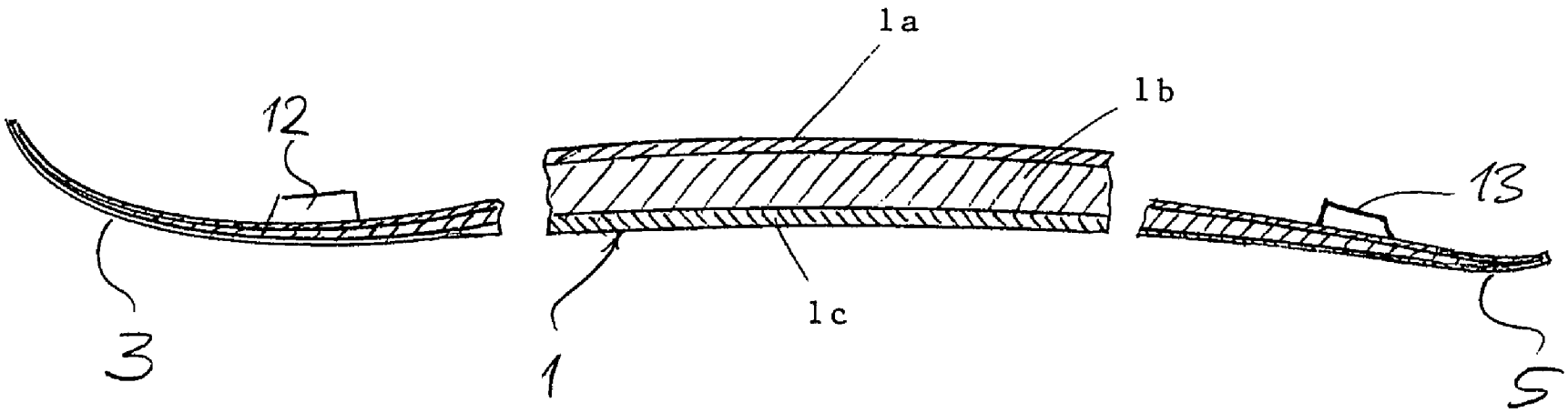
FIG. 6 illustrates a ski body assembled in a sandwich structure.

The illustrated downhill ski comprises a ski body 1, which has a running surface 2, a front end 3 with a tip 4 that bends upward and a back end 5. The ski body 1 has the shape of an elongate, flat and narrow plate, which is slightly curved in the longitudinal direction in such a way that the running surface 2 has a concave curvature. The ski body 1 is assembled in a sandwich structure from a plurality of elements and/or layers 1*a*, 1*b*, 1*c*, which are connected to each other in an adhesive and/or interlocking manner, as shown in FIG. 6.

Figure 4:
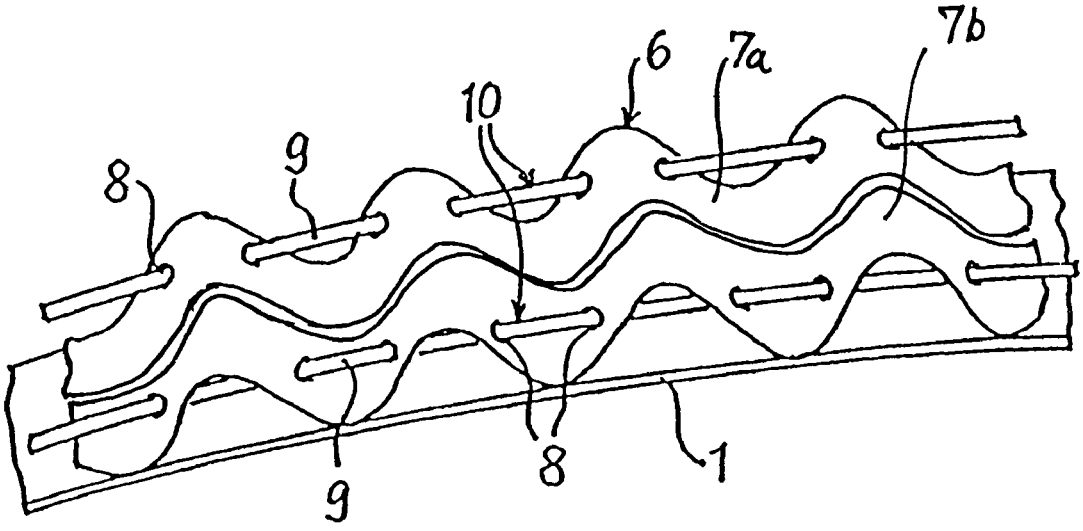
FIG. 4 illustrates the support structure formed from a plurality of components that lie side by side.
Figure 5:
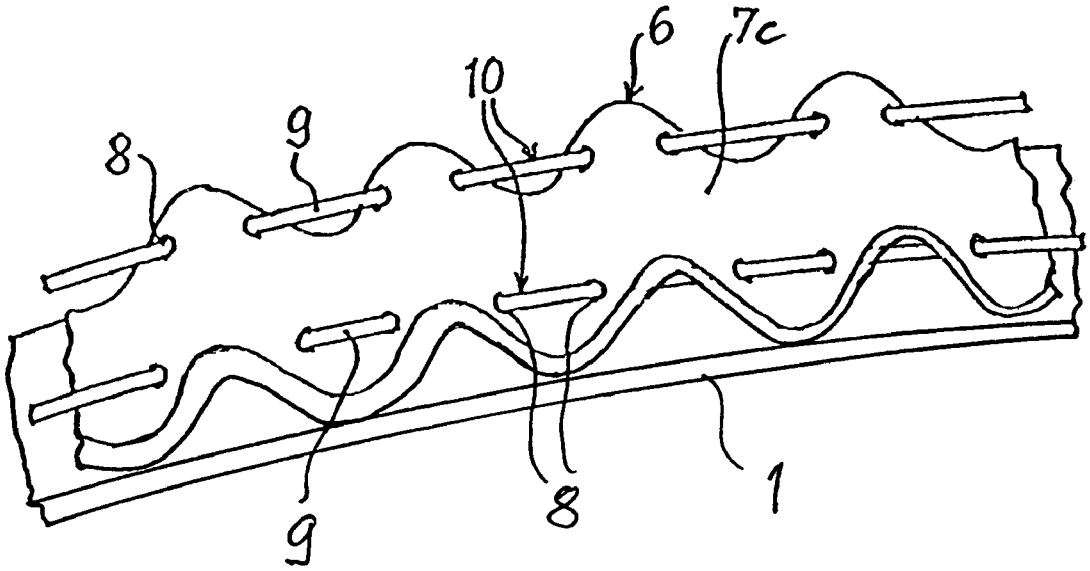
FIG. 5 illustrates a component forming the support structure having a non-uniform wall thickness.

A support structure 6, which extends from one end of the ski body 1 to the other, is arranged on the upper side of the ski body 1 facing away from the running surface 2. The support structure 6 consists of a thin-walled component 7, which has substantially the width of the ski body 1. The component 7 has an undulating shape formed by alternating curvature about substantially parallel axes of curvature, which extend transversely to its longitudinal direction. The component 7 preferably consists of a composite of a plastics material and a fabric made of high-strength fibers having different fiber orientations. The material thickness of the component 7 may vary between zones that are subjected to more or less stress. For example, the component 7*c* forming the support structure may have a uniform wall thickness, but its wall thickness may also be non-uniform, as shown in FIG. 5. Further, the support structure can be formed from a plurality of components 7*a*, 7*b* that lie side by side, as shown in FIG. 4. The support structure 6 lies with its lower undulation portions directly on the ski body 1 and is preferably attached to the ski body 1 in these locations by adhesive or mechanical means.

The upper undulation portions of the support structure 6, which are raised compared to the surface of the ski body 1, are provided with through-openings 8 at a distance from the ski body 1. Two struts 9, which form an upper chord element 10, are mounted, side by side with spacing, in the openings 8. The struts 9, which are preferably configured as circular tubes, are arranged symmetrically about the centre plane of the downhill ski. The ends of the struts are held on the ends 3, 5 of the ski body 1 and are supported on the ski body 1 in the longitudinal direction by resilient supports 12, 13. The resilient supports 12, 13 may be configured as shock-absorbing arrangements. The distance between the struts 9 and the ski body 1 is greatest in the centre of the ski and decreases continuously toward the ski ends. The same applies to the overall height of the support structure 6, which also decreases from the centre of the ski to the ski ends.

The support structure 6 is covered by a thin-walled plate 11 in its centre region. The plate 11 is connected to the support structure 6 by adhesive means and/or by interlocking fastening means, for example screws. The plate 11 may, in the same way as the support structure 6, be used to attach a ski binding or a binding carrier plate.

Figure 1:
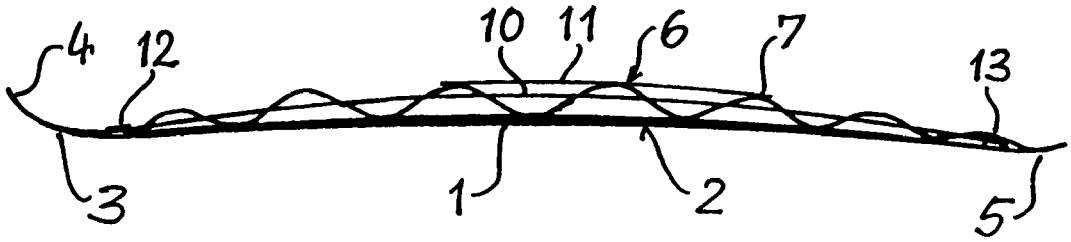
FIG. 1 is a side view of a downhill ski according to the invention.
Figure 2:
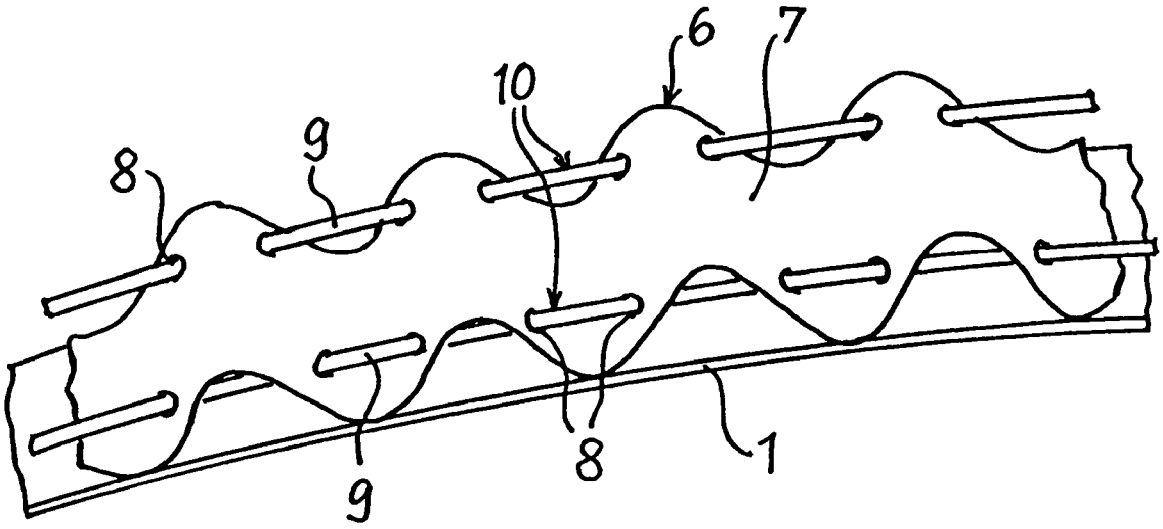
FIG. 2 is a perspective view of a fragment of the downhill ski according to FIG. 1.
Figure 3:
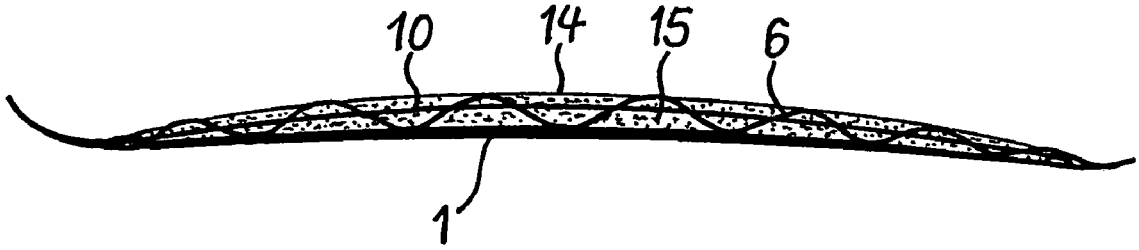
FIG. 3 is a longitudinal section of a downhill ski according to the invention with a box-shaped casing.

FIG. 3 shows an embodiment, in which the support structure 6 and the upper chord element 10 are enclosed by a box-shaped casing 14. The casing 14 is attached to the ski body 1 and has a dimensionally stable surface. In the space 15 enclosed by the casing, the gaps between the support structure 6, the ski body 1 and the chord element 10 are filled with a resiliently yielding material, for example a plastic foam.

The described downhill ski is distinguished by its particularly good running properties. These good running properties are achieved by a favorable relationship between flexional elasticity and torsional strength so that the ski can readily adapt to the unevenness of the piste, but at the same time ensures distribution of edge pressure, which makes it possible to control the ski in the required manner at the edge, particularly when employing the carving skiing technique. Furthermore, the configuration according to the invention contributes towards good damping behavior, so that oscillations of the ski ends may be effectively prevented.

The invention claimed is:

1. Downhill ski having a ski body, which has a running surface on its under side and, on its upper side facing away from the running surface, comprises at least one upper chord element which extends in the longitudinal direction of the ski body, absorbs tensile and compressive forces, and is mounted to the ski body by its ends, wherein on the upper side of the ski body there is arranged a support structure, on which the upper chord element is supported and which is formed from an elongate flat component that is bent at intervals in alternating directions in each case at an angle to the running surface, wherein each bend in the elongate flat component has substantially parallel axes, which extend transversely to the longitudinal direction of the ski, said support structure having a plurality of openings through which the at least one upper chord element passes in a single arc between its ends from one end of the support structure to an opposite end.

2. Downhill ski according to claim 1, characterized in that the support structure has an undulating form.

3. Downhill ski according to claim 1, characterized in that the support structure is made of a fiber/plastics material composite.

4. Downhill ski according to claim 1, characterized in that the support structure is made of a metal sheet.

5. Downhill ski according to claim 1 characterized in that the wall thickness of the component of the support structure varies.

6. Downhill ski according to claim 1, characterized in that the overall height of the support structure decreases from the centre of the ski toward the ends of the ski.

7. Downhill ski according to claim 1, characterized in that the support structure is formed from a plurality of components lying side by side.

8. Downhill ski according to claim 1, characterized in that the angle of inclination of the portions of the support structure which are inclined in relation to the running surface changes from the centre of the ski toward the ends of the ski.

9. Downhill ski according to claim 1, characterized in that the upper chord element comprises one or more rods or tubes made of high-strength material.

10. Downhill ski according to claim 1, characterized in that the upper chord element passing through the support structure is at a distance from the ski body (1).

11. Downhill ski according to claim 10, characterized in that the upper chord element is supported in a sliding manner in the openings or recesses of the support structure.

12. Downhill ski according to claim 1, characterized in that the support structure is connected to the ski body by adhesive or cohesive means and/or by mechanical means.

13. Downhill ski according to claim 1, characterized in that the support structure is at least partly covered on its upper side by a thin-walled plate-shaped element.

14. Downhill ski according to claim 1, characterized in that a box-shaped casing, which encloses the support structure and the upper chord element, is attached to the ski body.

15. Downhill ski according to claim 1, characterized in that the ski body is configured as a sandwich construction.

* * * * *